United States Patent [19]

Ritzerfeld

[11] 3,962,489

[45] June 8, 1976

[54] COPY SHEET AND METHOD OF PRINTING THE SAME

[76] Inventor: Gerhard Ritzerfeld, Schorlemer Allee 14, 1000 Berlin 33, Germany

[22] Filed: Apr. 26, 1974

[21] Appl. No.: 464,705

[30] Foreign Application Priority Data

May 17, 1973 Germany ..... 2325439
July 5, 1973 Germany ..... 2334689

[52] U.S. Cl. ..... 427/144; 101/469; 101/472; 427/146; 427/150; 427/152; 428/420; 428/454; 428/514; 428/532; 428/539; 428/914

[51] Int. Cl.[2] ..... B41M 5/04; B41M 5/22

[58] Field of Search ..... 101/468, 469, 472, 473; 117/36.2, 35.6, 36.7–36.9; 161/206, 413, 257, 265, 245, 234, 188; 428/454, 914, 420, 510, 514, 522, 532, 535, 539

[56] References Cited

UNITED STATES PATENTS

| | | | |
|---|---|---|---|
| 2,288,389 | 6/1942 | Bour | 117/35.6 X |
| 3,033,709 | 5/1962 | Brown | 117/35.6 X |
| 3,094,417 | 6/1963 | Workman | 117/36.8 X |
| 3,107,174 | 10/1963 | Wartman | 117/36.8 X |
| 3,389,007 | 6/1968 | Oda et al. | 117/36.2 |
| 3,816,838 | 6/1974 | Higaki et al. | 117/36.2 X |
| 3,825,507 | 7/1974 | Boyd et al. | 117/35.6 X |

*Primary Examiner*—Harold Ansher
*Attorney, Agent, or Firm*—Michael J. Striker

[57] ABSTRACT

A copy sheet that is capable of being printed by a reaction which requires the presence of three components. One of these components is carried by a printing master and another of these components is supplied to the copy sheet immediately prior to the printing operation. The third component is carried by the copy sheet in the form of a layer provided on one side of a carrier sheet forming part of the copy sheet. The printing master is placed on a rotating drum and the layer on the carrier sheet is moistened to supply the still missing component and is thereafter urged into contact with the printing master by means of a counter-pressure roller. If, in making a series of prints on a number of copy sheets, one copy sheet in the sequence should fail to be conveyed to the printing location, the rotating printing master will contact the counter-pressure roller and apply thereto the component carried thereby. This gives rise to the problem that the back side of the next copy sheet will be printed by the counter-pressure roller since this side is moistened and also normally includes at least a small amount of the third component required for the reaction. This problem is eliminated by providing a layer on the back side of the copy sheet which is free of the third component.

5 Claims, 3 Drawing Figures

COPY SHEET AND METHOD OF PRINTING THE SAME

BACKGROUND OF THE INVENTION

The invention relates generally to printing and, more particularly, to the formation of an image on a copy sheet with a printing master.

Methods for making copies from printing masters are known wherein the printing master is provided with characters to be transferred or copied. The characters are mirror-reversed from the images formed thereby on the copy sheet or duplicating sheet and are made of a material which includes leucauramine. Here, a copy sheet is used which is provided on both sides thereof, that is, on the side to be printed and on the side opposite the latter, with a layer of attapulgite, the copy sheet being moistened prior to the printing operation. The images formed on the copy sheet are a result of a reaction which occurs due to the presence of three components, namely, the leucauramine, the attapulgite and the liquid used for moistening the copy sheet. To print a copy sheet, the printing master is set into rotation and a counter-pressure roller is used to urge the moistened copy sheet into contact therewith.

It has, however, been found that the use of a copy sheet provided with a layer of attapulgite on opposite sides thereof possesses a serious disadvantage when a machine having an automatic feeder for feeding the copy sheets to the printing master is utilized. Thus, if a misalignment of one copy sheet occurs so that this is not conveyed to the printing location or, at least, is not conveyed to the printing location at the requisite time, the still-rotating printing master will contact the counter-pressure roller. As a result, some of the material which constitutes the mirror-reversed characters on the printing master will be transferred to the counter-pressure roller. Consequently, the next copy sheet to be conveyed to the printing location will be printed on its back side, that is, the side opposite to that which it is desired to print with the printing master, by the counter-pressure roller. This is a result of the moistening or soaking of the copy sheet which is performed prior to the printing operation and which now assures that the three components necessary for the printing reaction are present at the back side of the copy sheet. Thus, a reaction occurs between the attapulgite-containing back side of the copy sheet and the leucauramine images transferred to the counter-pressure roller.

An attempt has been made to overcome the above problem by using paper carrier sheets provided with an attapulgite layer on one side only. However, this has not provided a satisfactory solution to the problem. First of all, the carrier sheet itself contains substances which are capable of reacting with the leucauramine of the printing master. Although such substances are present in the carrier sheet in much smaller amounts than in the layer provided on the carrier sheet, it is nevertheless true that faint images may be formed on the carrier sheet. Furthermore, carrier sheets having an attapulgite layer on one side only possess the tendency to curl up in one direction when the carrier sheets are provided with a layer in amounts which correspond to between 8 and 12 grams per square meter of surface area. This is particularly true when the humidity of the air changes. Consequently, it became impossible to satisfactorily convey the copy sheets by means of the automatic feeders in printing machines. In addition to the above, there arose the problem that the layman operating the machine could not tell the layered and unlayered sides of the copy sheets apart so that the copy sheets were often inserted in the printing machine in the wrong orientation.

SUMMARY OF THE INVENTION

It is, accordingly, a general object of the invention to provide a novel copy sheet and a novel method of making images.

Another object of the invention is to provide a method of making images whereby the formation of images on portions of the copy sheet which it is not desired to print may be prevented.

A further object of the invention is to provide a copy sheet whereby the formation of images on portions thereof which it is not desired to print may be prevented.

An additional object of the invention is to provide a copy sheet which is well-suited for use with automatic feeders.

It is also an object of the invention to provide a copy sheet whereby the tendency for curling up may be reduced.

Yet another object of the invention is to provide a copy sheet whereby the side to be printed may be readily recognized.

The above objects are achieved in accordance with the invention, as are others which will become apparent as the description proceeds. One feature of the invention, stated briefly, resides in a method of making an image wherein a printable character or printable original is contacted with at least one portion of a copy or duplicating sheet. The copy sheet includes a carrier sheet provided with a first or activation layer which constitutes this portion of the copy sheet. The activation layer is capable of undergoing an image-forming reaction with the printable character. The method of the invention includes the improvement which comprises preventing the formation of images at another portion of the copy sheet by covering the latter portion of the copy sheet with a second or so-called "inactive" layer which is essentially incapable of undergoing an image-forming reaction with the printable character. It will be understood that the term "inactive layer" as used herein is intended to denote a layer which is essentially incapable of undergoing an image-forming reaction with the printable character but is not intended to necessarily imply a layer which is totally inert.

Of particular interest for the invention is a method of copying or transferring printable original images onto a copy sheet using a moistening liquid and wherein the copy sheet has been prepared or treated on two opposite sides thereof and the printable original images are mirror-reversed from the images formed on the copy sheet. The printable original images may be formed by using a leucauramine-containing, layered transfer sheet. The copy sheet may comprise paper which has been treated or prepared on two opposite sides thereof and the moistening liquid may be an alcohol-containing liquid.

The side of the copy sheet to be printed may be provided with a layer which contains, for instance, a magnesium silicate, an aluminum silicate and/or a magnesium-aluminum silicate, examples being attapulgite, bentonite and the like. Thus, upon contact of this layer with a printing master provided with leucauramine-containing original mirror images, a coloring reaction may occur on the copy sheet when moistening is effected. On the other hand, no magnesium silicates, aluminum silicates or magnesium-aluminum silicates will, in this case, be added to the layer or coating which is to be provided on the side of the copy sheet which is not to be printed, which side might be the back side of the copy sheet, that is, the side thereof opposite the side to be printed. Rather, only substances which do not react with leucauramine such as, for instance, barium sulfate in an aqueous synthetic resin dispersion, will be included in the latter layer, whereby the formation of an image on the back side of the copy sheet by the counter-pressure roller may be prevented. It will be appreciated that the invention has overcome the disadvantages of the prior art methods as outlined above.

It is favorable when the layer for the back side of the copy sheet which is not to be printed is provided with a slightly alkaline pigment material. Advantageously, this layer is also provided with a slight, colored tint.

The invention further provides a copy or duplicating sheet for the formation of an image by reaction when contacted with a printable character or printable original image. The copy sheet comprises a carrier sheet having two surface portions, namely, a first or activable layer is provided on one of these surface portions and is capable of undergoing an image-forming reaction with the printable character. A second or inactive layer is provided on the other surface portion of the carrier sheet and is essentially incapable of undergoing an image-forming reaction with the printable character.

The copy sheet of the invention is particularly well-suited for use in carrying out the method of the invention. Thus, the side of the copy sheet to be printed is provided with a layer which, as already mentioned, may contain magnesium silicates, aluminum silicates and/or magnesium-aluminum silicates, for example, attapulgite. Advantageously, this layer includes a binding agent in which the silicate is embedded. On the other hand, a side of the copy sheet which is not to be printed, which might be a back side thereof, is provided with a layer or coating which does not contain the aforementioned silicates and which is neutral. The latter layer may be composed of a filler and/or a binding agent which are neutral. Advantageously, this latter layer is alkaline and it is also of advantage when this is tinted.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
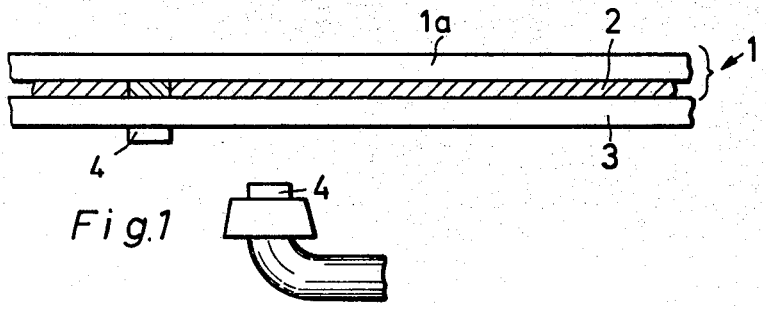
FIG. 1 is a side view illustrating one manner of preparing a printing master.

Referring first to FIG. 1, a transfer sheet for use in preparing a printing master is indicated generally at 1 and may be seen to include a backing sheet 1a provided with a transfer layer 2 at one surface thereof. A paper sheet 3 which is to be prepared so as to form a printing master or original is placed against the transfer layer 2 so that the latter and the sheet 3 overlie one another. Thereafter, a type 4 of a non-illustrated typewriter or the like is brought to bear against the surface of the sheet 3 opposite that which contacts the transfer layer 2. The impact of the type 4 against the sheet 3 produces a pressure which is transmitted to the transfer layer 2 and is effective for the preparation of the printing master. Instead of the type 4, it is also possible to use a suitable recording or marking instrument of some other kind. Likewise, in lieu of the type 4, it is possible to use a heating instrument having means for producing infrared radiation. In this case, it will be a heating effect which is responsible for the preparation of the printing master.

Figure 2:
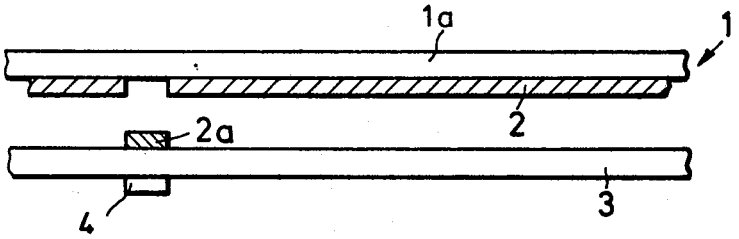
FIG. 2 is a side view further illustrating the preparation of the printing master of FIG. 1 and also showing the printing master after its preparation.

The results of the pressure exerted by the type 4, or by the heating effect produced by an infrared device, are best seen in FIG. 2 which shows the sheet 3 after this has been separated from the transfer sheet 1. It may be seen that a portion of the transfer layer 2 has been transferred from the transfer sheet 1 to the sheet 3 so as to form on the surface of the sheet 3 a printable original image or character 2*a* thereby producing a printing master comprising the sheet 3 and the original image 2*a*. The transfer of the transfer layer 2 to the sheet 3 occurs at those locations of the transfer layer 2 which have been subjected to pressure or have been subjected to differential heating by infrared rays.

In the present instance, the transfer layer 2 of the transfer sheet 1 is assumed to be composed of leuco dye materials and suitable binding agents. For example, the transfer layer 2 may include leucauramine as a dye material. Examples of binding agents which may be used are waxes, oils and/or fats or solutions of synthetic resins. The original image 2*a* on the sheet 3 will, of course, have a composition which is essentially the same as that of the transfer layer 2.

Figure 3:
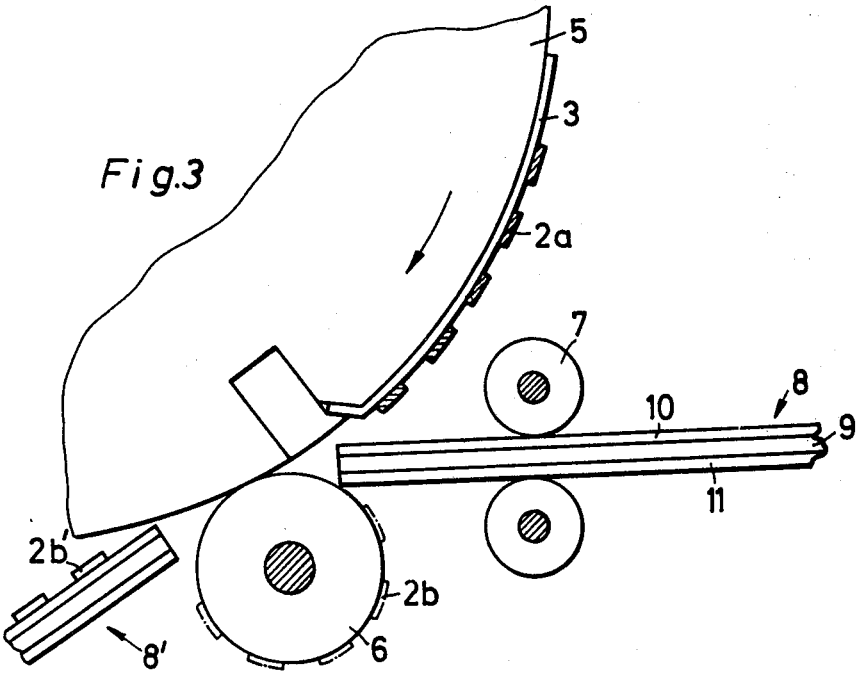
FIG. 3 is a side view showing a copy sheet in accordance with the invention and also illustrating schematically the method of the invention using the copy sheet and the printing master of FIGS. 1 and 2.

Referring now to FIG. 3, it may be seen that there is provided a printing drum 5 mounted for rotation in the direction indicated by the arrow. The sheet 3 with its associated original images 2*a* is mounted on the drum 5 and in such a manner that it is subjected to tension. The original images 2*a*, which are mirror-reversed from the images to be made therefrom, are not yet capable of producing dyeing or coloring effects.

The drum 5 is now set into rotation and copy or duplicating sheets are conveyed towards the drum 5 by means of a non-illustrated feeder, the direction of travel of the copy sheets being from right to left in the drawing. Prior to reaching the drum 5, the copy sheets pass through a moistening or wetting device 7 which moistens the copy sheets with a suitable liquid which is here assumed to be an alcohol-containing or alcohol-like liquid. After passing through the device 7, and upon reaching the vicinity of the drum 5, the copy sheets come into contact with a counter-pressure roller 6 which urges the copy sheets into engagement with the printing master on the rotating drum 5. The counter-pressure roller 6 thus provides for a firm contact between the copy sheets and the original images on the sheet 3 of the printing master.

One copy or duplicating sheet is shown and is indicated generally at 8. The copy sheet includes a paper carrier sheet 9 which is provided with a layer 10 at one side thereof and with a layer 11 at the opposite side thereof. As may be seen, the copy sheet 8 is so positioned that, when it passes between the counter-pressure roller 6 and the drum 5, the layer 10 faces the latter so that it is brought into contact with the original images 2*a* on the printing master whereas the layer 11 will face away from the drum 5 and will not contact the original images 2*a*.

The layer 10, which is an activable layer, is capable of undergoing an image-forming reaction with the original images 2*a* on the printing master. In other words, the layer 10 is located on that side of the copy sheet 8 which is to be printed and includes a substance which is able to react with the leuco dye material of the original images 2*a*. Examples of substances which may be used for the layer 10 in the present instance are magnesium silicates, aluminum silicates or magnesium-aluminum silicates such as attapulgite and active bentonite, as well as resins which contain phenolic groups. According to one embodiment of the invention, the layer 10 includes a silicate and a suitable binding agent in which the silicate is embedded.

The layer 11 is provided on the side of the copy sheet 8 which is not to be printed an is either neutral or alkaline in its reaction. In accordance with the invention, an important feature of the layer 11 resides in that it is inert with respect to the original images 2*a* of the printing master in the sense that is is incapable of undergoing an image-forming reaction with the original images 2*a* or, in the present instance, with the leuco dye material contained in the latter. Accordingly, in the present case, the layer 11 is substantially free of, for example, the above-mentioned silicates which may be incorporated in the layer 10. In the case presently under consideration, the neutral or alkaline layer 11 may, for example, comprise barium sulfate or zinc oxide and suitable binding agents. Examples of binding agents which may be used for the layer 11 are aqueous dispersions of synthetic resins, solutions of starches and dispersions of copolymers of vinyl chloride and vinyl acetate.

In the case being presently discussed, the image-forming reaction requires the simultaneous presence of three components, namely, the leuco dye material of the original images 2*a* of the printing master, the substance in the layer 10 such as a silicate which is able to react with the leuco dye material, and the alcohol-like liquid supplied by the device 7. Thus, if, for instance, the layer 10 or the original images 2a were not activated or wetted by the liquid supplied by the device 7, the image-forming reaction could not take place. On the other hand, it may be seen that the layer 11 cannot undergo an image-forming reaction with the original images 2a even if the liquid supplied by the device 7 were present since one of the components necessary for the reaction is missing, that is, the layer 11 does not contain a substance which is capable of reacting with the leuco dye material of the original images 2a to produce an image.

As already mentioned, the printing master, which includes the sheet 3 and the original images 2a, is mounted on the drum 5 which is then set into rotation. The copy sheets 8 are then fed towards the drum 5. Prior to reaching the drum 5, the copy sheets 8 pass through the device 7 which moistens them. Thereafter, the copy sheets 8 pass between the drum 5 and the counter-pressure roller 6, which latter urges the copy sheets 8 into engagement with the original images 2*a* so that an image-forming reaction takes place. Of course, the copy sheets 8 are to be positioned in such a manner that it is the layer 10 thereof which faces the drum 5 and is contacted with the original images 2*a* of the printing master. FIG. 3 shows part of a copy sheet, designated generally at 8′, which has just passed between the drum 5 and the counterpressure roller 6 and it may be seen that images 2*b′* have been produced on the layer 10.

As the drum 5 continues to rotate and copy sheets 8 continue to be fed to the printing location between the drum 5 and the counter-pressure roller 6, there exists the possibility of, for example, a faulty alignment of one of the copy sheets 8 so that this is not conveyed to the printing location or is not conveyed to the printing location at the requisite instant. Since the drum 5 continues to rotate, the printing master will, in such an event, come into contact with the counter-pressure roller 6. When this happens, some of the material forming the originals 2*a* of the printing master will be transferred to the counterpressure roller 6 thereby forming the mirror originals 2*b* on the latter.

Mirror images 2b of the original images 2a are, at this time, not yet activated since they have not been supplied with the liquid from the device 7. However, if a copy sheet 8 is now passed through the device 7 and thereby moistened with the alcohol-like liquid supplied by the latter, there exists the danger that the still inactive mirror images 2*b* formed on the counter-pressure roller 6 by the conntinued rotation of the drum 5 when no copy sheet had been conveyed to the printing location will be activated by the moist copy sheet 8. In other words, there exists the danger that the moist copy sheet 8 conveyed to the printing location after a revolution of the drum 5 during which no copy sheet 8 had been conveyed to the printing location may activate the mirror images 2*b* produced by virtue of the contact between the original images 2*a* of the printing master and the counter-pressure roller 6. As a result, if a copy sheet is used which is of such a nature that the back side thereof, that is, the side thereof opposite the side to be printed, is able to undergo an image-forming reaction with the material of the original images 2*a* of the printing master, there exists the possibility that an undesired image will be produced on all copy sheets which are conveyed to the printing location subsequent to the activation of the mirror images 2*b* on the counter-pressure roller 6. In accordance with the invention, however, this is prevented by the neutral or alkaline layer 11 provided on the back side of the copy sheets 8. In this connection, it will be recalled that one of the three components required for the image-forming reaction will be missing when the moistened layer 11 contacts the mirror images 2*b*, namely, a substance such as a silicate or the like contained in the layer 10 and which is able to react with the leuco dye material in the mirror images 2*b*.

The layer 11 may include a pigment material which is preferably slightly alkaline. In addition, the layer 11 provided on the back side of the copy sheet 8 may be colored or tinted. This avoids the possibility that the printing machine operator inserts the copy sheet 8 into the printing machine in the wrong orientation. Thus, if the copy sheet 8 should be inserted into the printing machine in the wrong orientation, no reaction or formation of a colored outline corresponding to the original images 2*a* on the printing master will occur despite moistening of the copy sheet 8 since one of the three components necessary for the formation of such an outline will be missing.

In addition to its function for preventing the formation of undesired images on the back side of the copy sheet 8, which is provided at its front side, or the side to be printed, with the activable layer 10, the layer 11 further serves to prevent curling up of the copy sheet 8. Thus, disturbances or interruptions when the copy sheets 8 are automatically fed or conveyed to the printing location are avoided, that is, the copy sheets 8 may be fed in a trouble-free manner using automatic feeding apparatus.

The following examples are intended to illustrate compositions for the layer 11 in accordance with the invention but are not to be construed as limiting the invention in any manner:

EXAMPLE 1

| | |
|---|---|
| Zinc Oxide or Barium Sulfate | 70 to 80 parts by weight |
| Acronal-S-325-D | 15 to 25 parts by weight |
| Polysalz | 0.5 to 1 parts by weight |
| Urecoll | 1 to 2 parts by weight |

The substances Acronal-S-325-D, Polysalz and Urecoll are the trade names of substances marketed by the BASF Company of Germany. Acronal-S-325-D is composed of of vinyl chloride and vinyl acetate copolymers whereas Polysalz is composed of an aqueous solution of the sodium salts of a polycarbonic acid. Urecoll is composed of an aqueous solution of urea condensation products. The substance Acronal-S-325-D serves as a binding agent whereas the substances Polysalz and Urecoll serve as agents for improving flowability.

The above-mentioned substances are stirred into water and dispersed in a ball mill or bead mill, for instance. The quantity of water is advantageously between about 50 and 70 percent by weight. The resulting dispersion is then applied to a carrier sheet in an amount which corresponds to between approximately 6 and 10 grams per square meter of surface area. The application may be performed using a conventional paper-coating apparatus.

EXAMPLE 2

An aqueous solution containing about 5 to 10 percent by weight of carboxymethyl cellulose is formed. This solution is applied to a carrier sheet using a conventional size press. The layer thickness is here likewise chosen so that between about 6 and 10 grams of carboxymethyl cellulose cover a square meter of surface area.

In accordance with the invention, it is particularly advantageous when the layer 11 of the copy sheet 8 consists at least predominantly of carboxymethyl cellulose. The reason is that this permits the production of the copy sheet 8 to be accomplished in a particularly simple, rapid and inexpensive manner. It is also of advantage here when the layer 11 includes a coloring or dyeing agent.

The reason why the use of carboxymethyl cellulose is particularly favorable is as follows: When the layer 11 includes substances such as zinc oxide or barium sulfate, as well as suitable binding agents such as, for instance, a starch solution or a dispersion of copolymers of vinyl chloride and vinyl acetate, it is necessary that, subsequent to production of the carrier sheet 9, the latter be coated with different materials on opposite sides thereof in order to produce the copy sheet 8. This procedure is relatively costly and time-consuming.

In contrast, the advantage of using carboxymethyl cellulose as a coating material resides in that this material may be provided on the carrier sheet 9 already during the production of the latter, while this is not possible for the other-mentioned substances. Moreover, the carboxymethyl cellulose may be coated onto the carrier sheet 9 with the aid of size presses which are conventionally used in the production of the carrier sheet 9. Thus, no additional, special apparatus are required for the coating of the carrier sheet 9 with carboxymethyl cellulose. In addition, the production time for the carrier sheet 9 is not lengthened by coating the latter with a layer of carboxymethyl cellulose.

Therefore, by providing for the layer 11 of the copy sheet 8 to consist at least predominantly of carboxymethyl cellulose, a relatively costly coating procedure subsequent to production of the carrier sheet 9 may be eliminated. On the other hand, the coating with carboxymethyl cellulose which is carried out instead during the production of the carrier sheet 9 involves only a minimal additional expense. As already mentioned, it is also possible to add a coloring or dyeing agent to the carboxymethyl cellulose and this agent may be coated on the carrier sheet 9 together with the carboxymethyl cellulose. In this manner, copy sheets with any desired coloring on the back sides thereof may be produced.

It will be understood that each of the elements described above, or two or more together, may also find a useful application in other types of copy sheets and methods differing from the types described above.

While the invention has been illustrated anad described as embodied in a copy sheet and method of printing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A copy sheet adapted for receiving images by transfer from a master sheet upon which master sheet mirror relief images formed from a composition consisting essentially of a leucauramine dye and a binder therefor have been impressed, the image-receiving surface of the said copy sheet being coated with a layer of a composition consisting essentially of a binder and a substance selected from the group consisting of magnesium silicates, aluminum silicates, and magnesium aluminum silicates that reacts to form a colored image when brought into contact with a leucauramine dye and an alcohol-containing liquid, and the opposite surface of the said copy sheet being coated with a layer of a composition consisting or carboxymethylcellulose or particles of zinc oxide or barium sulfate and a binder therefor consisting of starch or a copolymer of vinyl chloride and vinyl acetate, which opposite surface layer is essentially free of substances that react to form a colored image when brought into contact with a leucauramine dye an an alcohol-containing liquid.

2. A copy sheet as defined in claim 1 in which the substance that reacts to form a colored image when brought into contact with a leucauramine dye and an alcohol-containing liquid is attapulgite.

3. A copy sheet as defined in claim 1 in which the substance that reacts to form a colored image when brought into contact with a leucauramine dye and an alcohol-containing liquid is bentonite.

4. A copy sheet as defined in claim 1 in which the layer of the composition with which the surface opposite the image-receiving surface is coated also comprises a conventional coloring agent.

5. A copy sheet as defined in claim 1 in which the layer of the composition with which the surface opposite the image-receiving surface is coated consists essentially of carboxymethylcellulose.

* * * * *